US006811131B2

(12) United States Patent
Kuo

(10) Patent No.: US 6,811,131 B2
(45) Date of Patent: Nov. 2, 2004

(54) ADJUSTABLE SUPPORTING TOOL FOR LCD PANEL

(75) Inventor: Robin Kuo, Taoyuan (TW)

(73) Assignee: Hannstar Display Corp., Taipei (TW)

( * ) Notice: Subject to any disclaimer, the term of this patent is extended or adjusted under 35 U.S.C. 154(b) by 23 days.

(21) Appl. No.: 10/291,655

(22) Filed: Nov. 12, 2002

(65) Prior Publication Data

US 2003/0150970 A1 Aug. 14, 2003

(30) Foreign Application Priority Data

Feb. 8, 2002 (TW) ..... 91102731 A

(51) Int. Cl.[7] ..... A47B 91/00

(52) U.S. Cl. ..... 248/346.03; 33/1 M; 33/613; 33/645; 33/549; 269/45; 269/289 R; 269/109; 248/154; 248/310; 248/346.06; 248/346.07

(58) Field of Search ..... 248/346.06, 346.07, 248/451, 298.1, 295.11, 346.03, 678, 670, 157, 510, 310, 680; 356/121, 244, 237.1; 108/20; 33/1 M, 613, 645, 549; 269/45.4, 289 R, 109, 43, 44, 50, 60, 300, 58, 111

(56) References Cited

U.S. PATENT DOCUMENTS 288,035 A * 11/1883 Dixon ..... 269/104
1,490,608 A * 4/1924 Gilmour ..... 269/104
4,549,727 A * 10/1985 Kozar ..... 269/70
5,052,454 A * 10/1991 Meinhardt ..... 144/144.51
5,297,485 A * 3/1994 Bond ..... 108/55.1
5,326,147 A * 7/1994 Watson ..... 294/162
5,486,841 A * 1/1996 Hara et al. ..... 345/8
5,616,146 A * 4/1997 Murray ..... 606/80
5,660,381 A * 8/1997 Suzuki ..... 269/73
6,112,783 A * 9/2000 Newman ..... 144/144.52
6,145,207 A * 11/2000 Brunson ..... 33/199 R
6,182,371 B1 * 2/2001 Newman ..... 33/194
6,375,134 B1 * 4/2002 Goldschmidt et al. ..... 248/154
6,450,782 B1 * 9/2002 Sakamoto ..... 417/359
2002/0156365 A1 * 10/2002 Tsekos ..... 600/411

* cited by examiner

*Primary Examiner*—Kimberly Wood

(57) ABSTRACT

An adjustable supporting tool for an LCD panel, comprises a baseboard, defining a longitudinal axis and a transversal axis, and the intersection point of the longitudinal and transversal axes is set as the central positioning point for the optical measurement; two transversal clipping devices, each having two fixing members, and each fixing member is fixed to the transversal axis, and a sliding track is disposed between the fixing members, and a first clamping member slides along the sliding track to clamp the longitudinal edge of an LCD panel in position, and the first clamping member is coupled to a caliper ruler to show the position of the clamping member, and at least one longitudinal clamping device, each having two fixing members, and the fixing member is fixed to the longitudinal axis, and a sliding track is disposed between the fixing members, and a second clamping member slides along the sliding track to clamp the transversal edge of an LCD panel in position, and the second clamping member is coupled to a caliper ruler to show the position of the clamping member.

2 Claims, 8 Drawing Sheets

ADJUSTABLE SUPPORTING TOOL FOR LCD PANEL

BACKGROUND OF THE INVENTION

1. Field of the Invention

The present invention relates to an adjustable supporting tool, more particularly to an adjustable supporting tool for LCD panel, which is applicable to the LCD panel of different sizes, and it utilizes a numeral display to show the position of a clamping member and thus facilitates users to observe and confirm that the central position of the LCD panel is clamped and located at the central position for an optical measurement.

2. Description of Related Art

In the liquid crystal display (LCD) manufacturing process, an LCD panel has to go through an optical measurement for optical analysis by measuring the optical features of the LCD including resolution, brightness, color saturation, view angle, and response time, etc. that comply with the requirements of the specification and ensure the yield rate and the quality of the manufactured LCD.

When the LCD panel undergoes an optical measurement for optical analysis, it needs an supporting tool to fix the LCD panel in front of the lens of the optical analyzer, and locate the central position of the LCD panel to the central positioning point of the lens for a precise measurement of the optical features such as the resolution, brightness, color saturation, view angle, and response time. The current supporting tool is tailor-made according to the size of the LCD panel, and the LCD panels of different specifications or sizes need to use specific supporting tool. In other words, each supporting tool can only be used for the LCD panel of one specific size. However, when the size of the LCD panel is changed, the supporting tool for the original size is no longer applicable, and a new tailor-made supporting tool of a specific size is needed.

To solve the foregoing problem occurred in the LCD manufacturing process, the current supporting tool definitely needs improvement to overcome the shortcoming of the non-universal application of the supporting tool.

SUMMARY OF THE INVENTION

The object of the present invention is to provide an adjustable supporting tool for LCD panel, which is applicable to the LCD panels of several different sizes without having to change the supporting tool.

Another object of the present invention is to provide an adjustable supporting tool for LCD panel, which utilizes a numeral display to show the position of the clamping member to facilitate users to observe and confirm the central position of the LCD panel that is clamped and located at the central position of the optical measurement.

In order to achieve the foregoing objects, the adjustable supporting tool for LCD panels of the present invention comprises a baseboard, defining a longitudinal axis and a transversal axis, and the intersection point of the longitudinal and transversal axes is set as the central positioning point for the optical measurement; two transversal clamping devices, each having two fixing members, and each fixing member is fixed to the transversal axis, and a sliding track is disposed between the fixing members, and a first clamping member slides along the sliding track to clamp the longitudinal edge of an LCD panel in position, and the first clamping member is coupled to a caliper ruler to show the position of the clamping member; and at least one transversal clamping device, each having two fixing members, and the fixing member is fixed to the transversal axis, and a sliding track is disposed between the fixing members, and a second clamping member slides along the sliding track to clamp the transversal edge of an LCD panel in position, and the second clamping member is coupled to a caliper ruler to show the position of the clamping member.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DESCRIPTION OF THE PREFERRED EMBODIMENT

Figure 1:
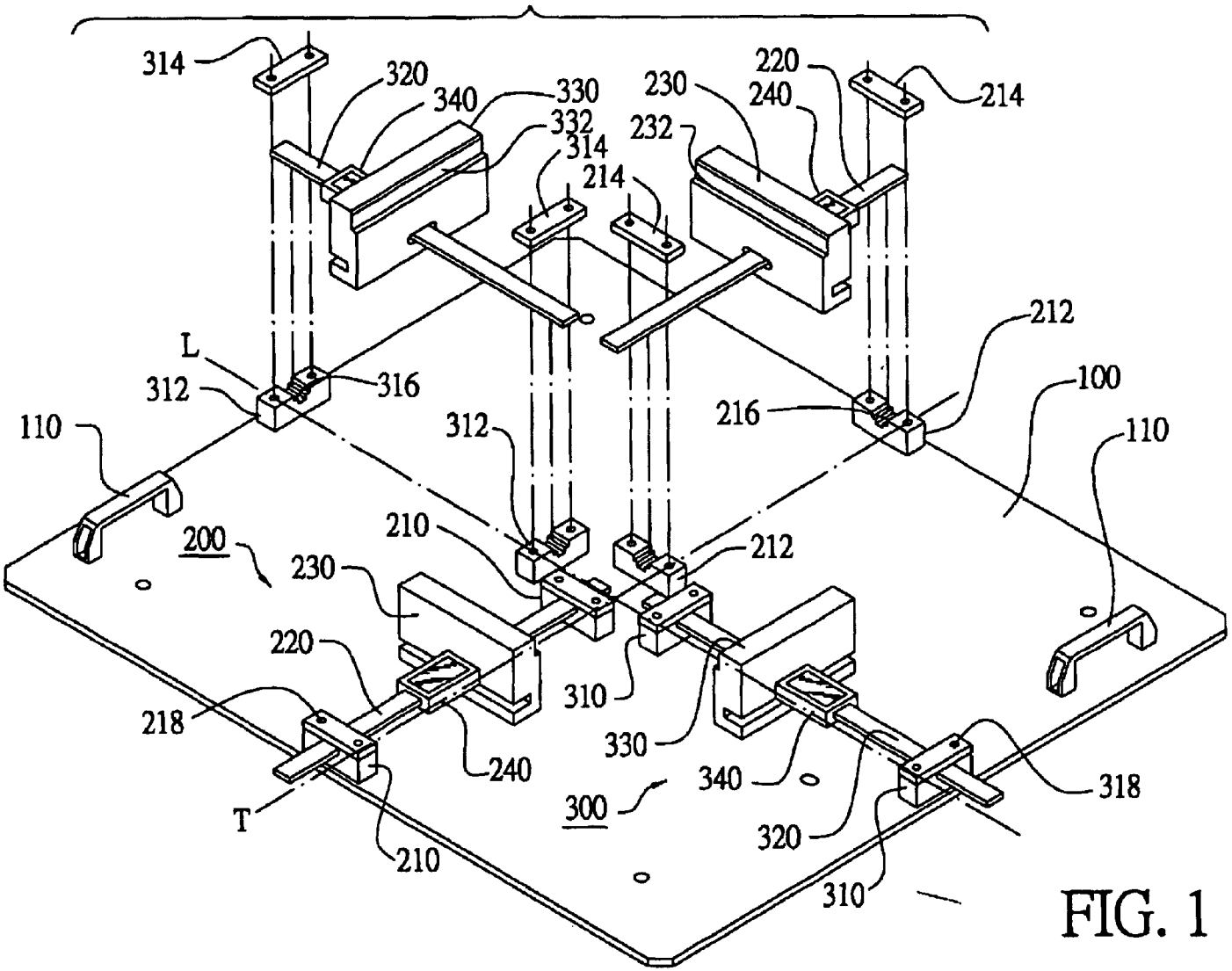
FIG. 1 shows the explosive view of the adjustable supporting tool for LCD panel according to the first embodiment of the present invention.

Referring to FIG. 1, it shows the adjustable supporting tool for LCD panel according to the first embodiment of the present invention. The adjustable supporting tool mainly comprises a baseboard 100, a pair of transversal clamping devices 200 and a pair of longitudinal clamping devices 300, wherein the baseboard 100 has a longitudinal axis L and a transversal axis T, and the intersection point of the longitudinal and transversal axes L, T is set as the central positioning point for the optical measurement. Each of the pair of transversal clamping devices 200 has two fixing members 210, and each fixing member is fixed to the transversal axis T. Moreover, a sliding track 220 is disposed between the fixing members 210, and a clamping member 230 slides along the sliding track 220 to clamp the longitudinal edge of a LCD panel 10 in position, and the clamping member 230 is coupled to a caliper ruler 240 which shows the position of the clamping member 230. Each of the pair of longitudinal clamp device 300 has two fixing 310 which are fixed to the longitudinal axid L. A sliding track 320 is diposed between the fixing members 310, and a clampoing member 330 slides along the sliding track 310 to clamp the transversal edge of an LCD panel 10 in position. Furthermore, the clamping member 330 is coupled to caliper ruler 340 which shows the position of the clamping member 330. Preferably, a handle 110 is disposed on the baseboard 100 for the user to hold.

Detailed description about the structure of the transversal clamping device 200 is given below. A fixing member 210 comprises a fixing base 212 and a press bracket 214. The fixing base 212 has a recession to accommodate the sliding track 220. After the press bracket 214 is placed on the fixing base 212, a fastening member 218 mounts the press bracket 214, the sliding track 220, and the fixing base 212 along the transversal axis T on the baseboard 100. The clamping member 230 can slide on the sliding track 220 between two fixing members 210, and the caliper ruler 240 coupled to the clamping member 230 shows the shifting position of the clamping member 230 on the sliding track 220. More preferably, the caliper ruler 240 utilizes the LCD numerals for displaying the shifted position of the clamping member 230 on the sliding track 220. Such clamping member 230 has a clamping groove 232 to clamp the longitudinal edge of the LCD panel 10.

As shown in the same figure, the longitudinal clamping device 300 of the present invention has the same structure as that of the aforementioned transversal clamping device 200, therefore the description about the structure for the clamping member 300 will not be repeated here. In the preferable embodiment, the longitudinal clamp devices 300 is operated in pair, but it is not required to put in pair.

Figure 2:
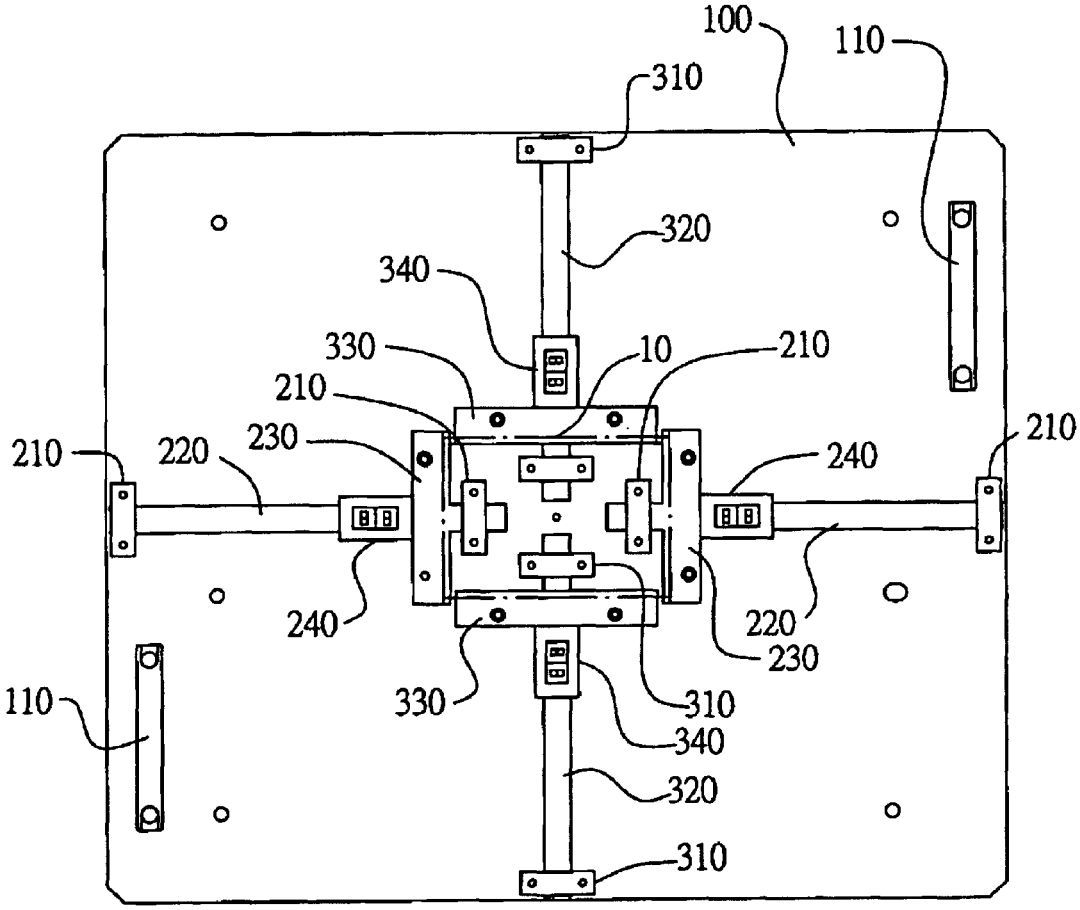
FIG. 2 shows the top view of the adjustable supporting tool for LCD panel according to the first embodiment of the present invention, while the supporting tool is clamping an LCD panel in position.
Figure 3:
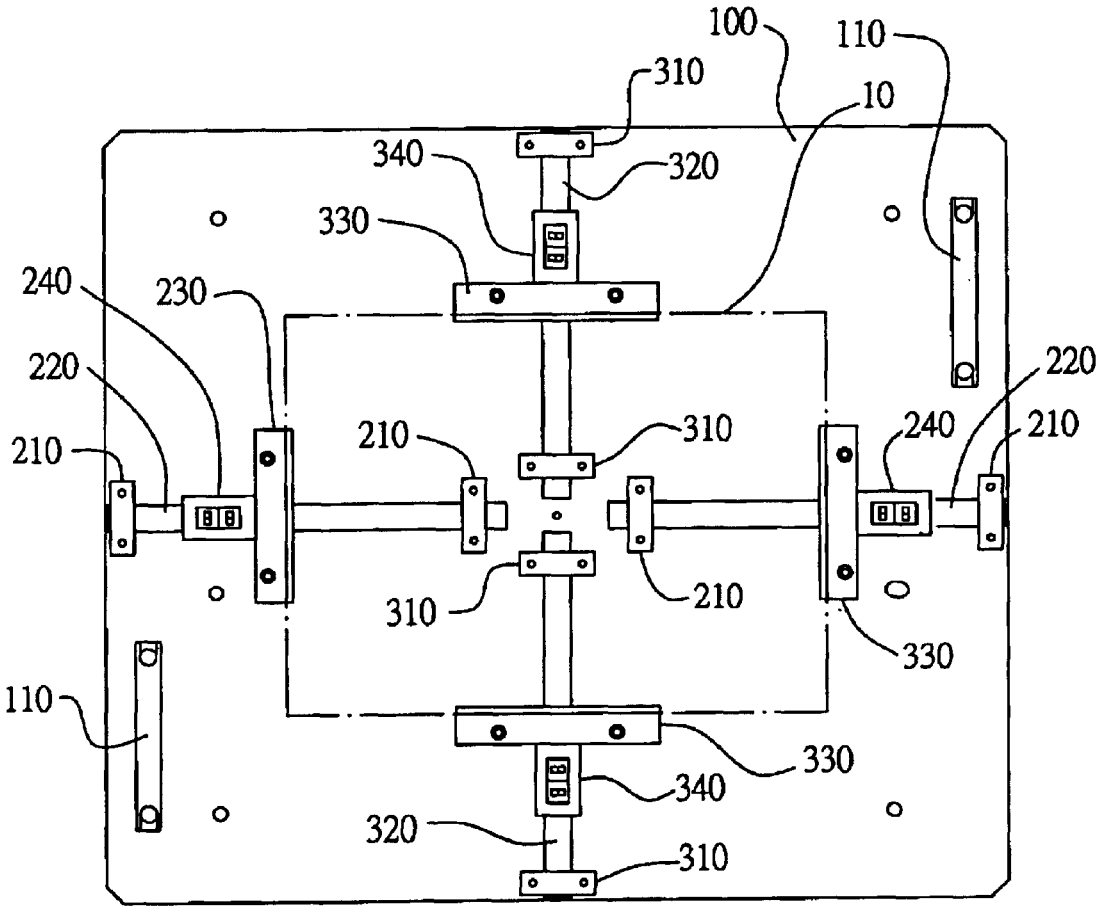
FIG. 3 shows the top view of the adjustable supporting tool for LCD panel according to the first embodiment of the present invention, while the adjustable supporting tool is clamping another LCD panel of different size in position.
Figure 4:
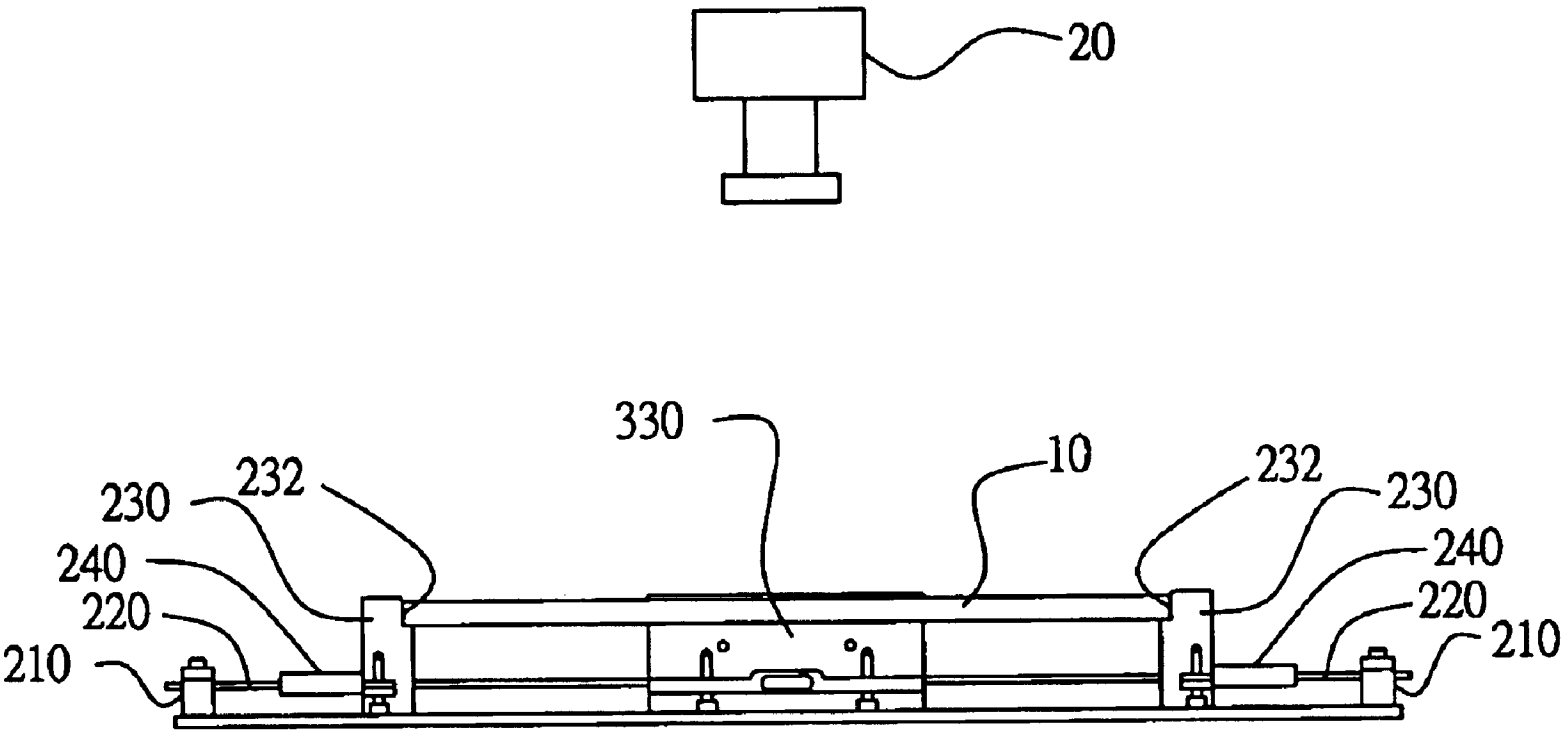
FIG. 4 shows the side view of the adjustable supporting tool for LCD panel according to the first embodiment of the present invention, while the LCD panel is horizontally disposed below the lens of the horizontal optical analyzer.
Figure 5:
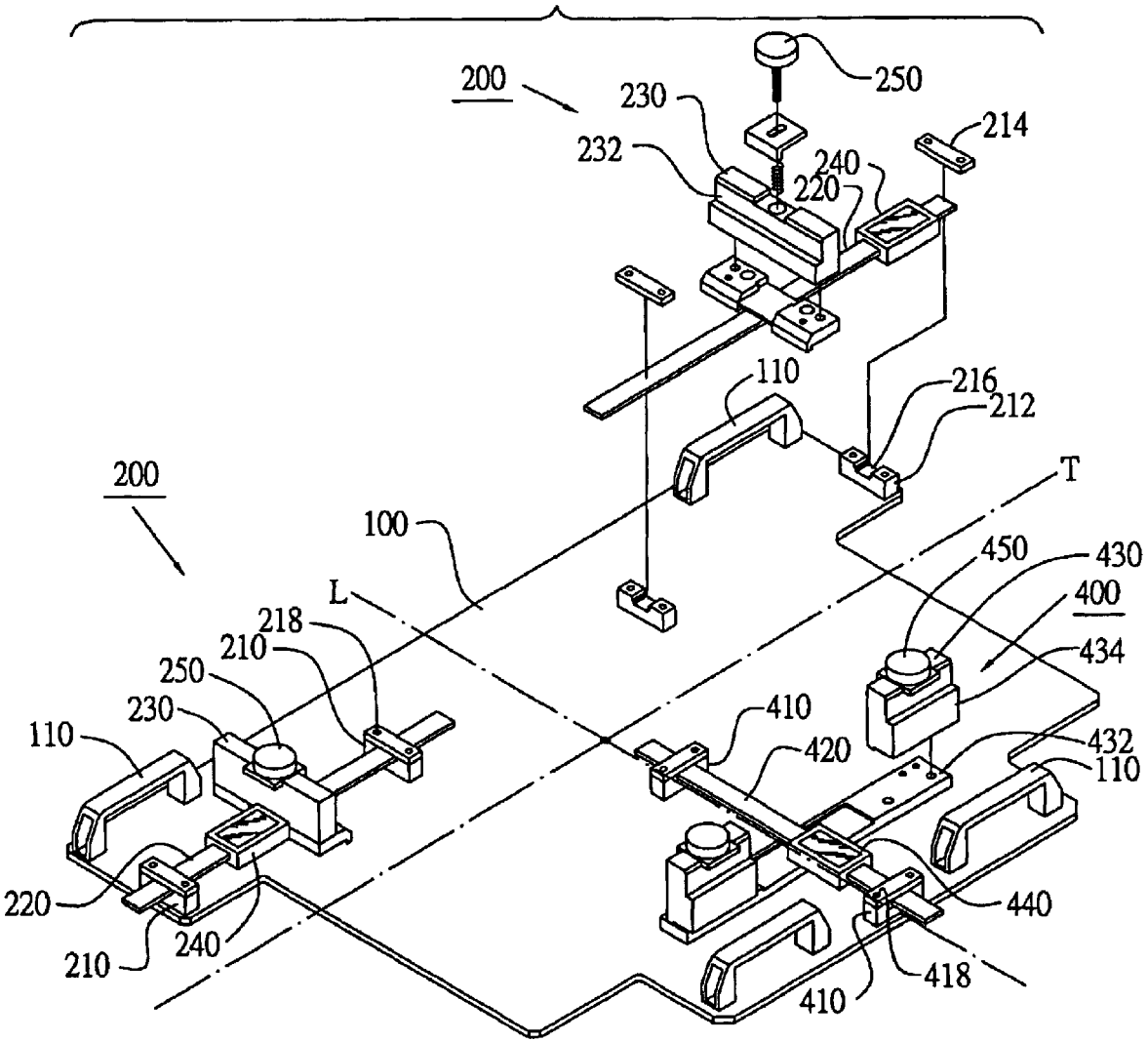
FIG. 5 shows the explosive view of the adjustable supporting tool for LCD panel according to the second embodiment of the present invention.
Figure 6:
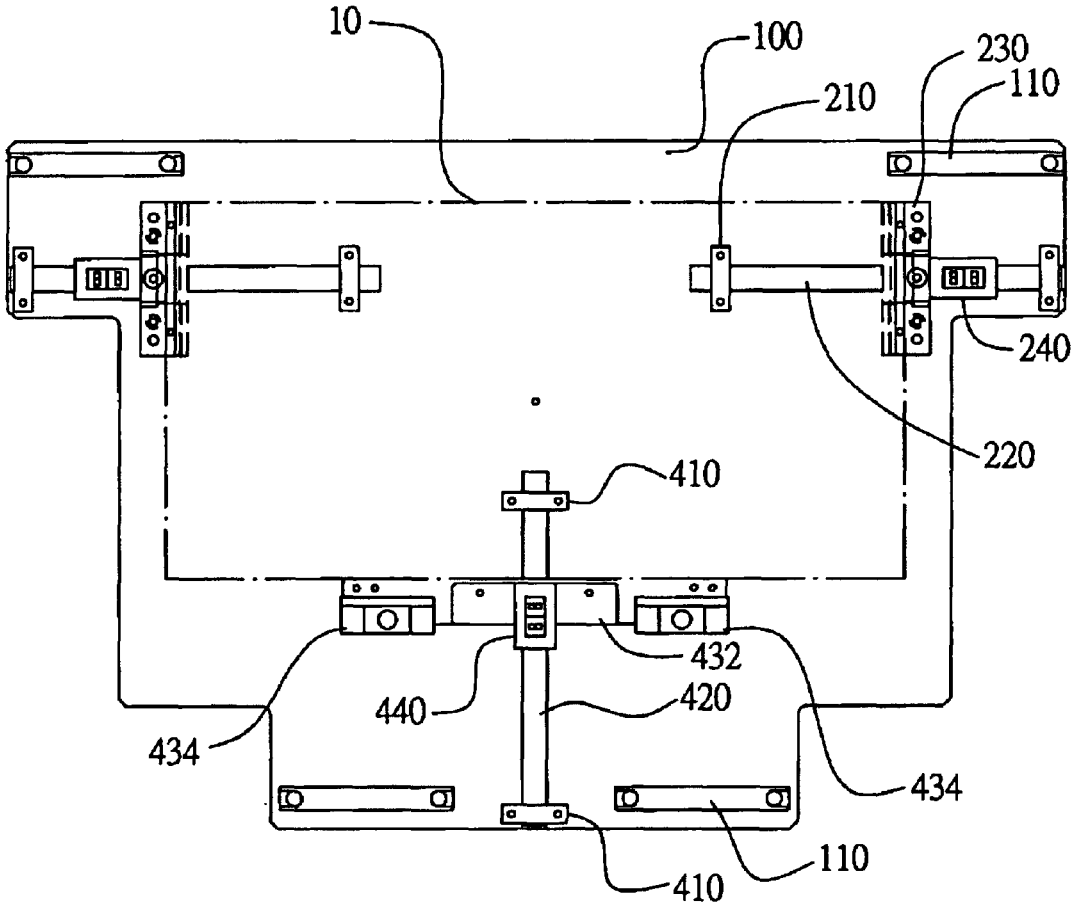
FIG. 6 shows the top view of the adjustable supporting tool for LCD panel according to the second embodiment of the present invention, while the supporting tool is clamping an LCD panel in position.
Figure 7:
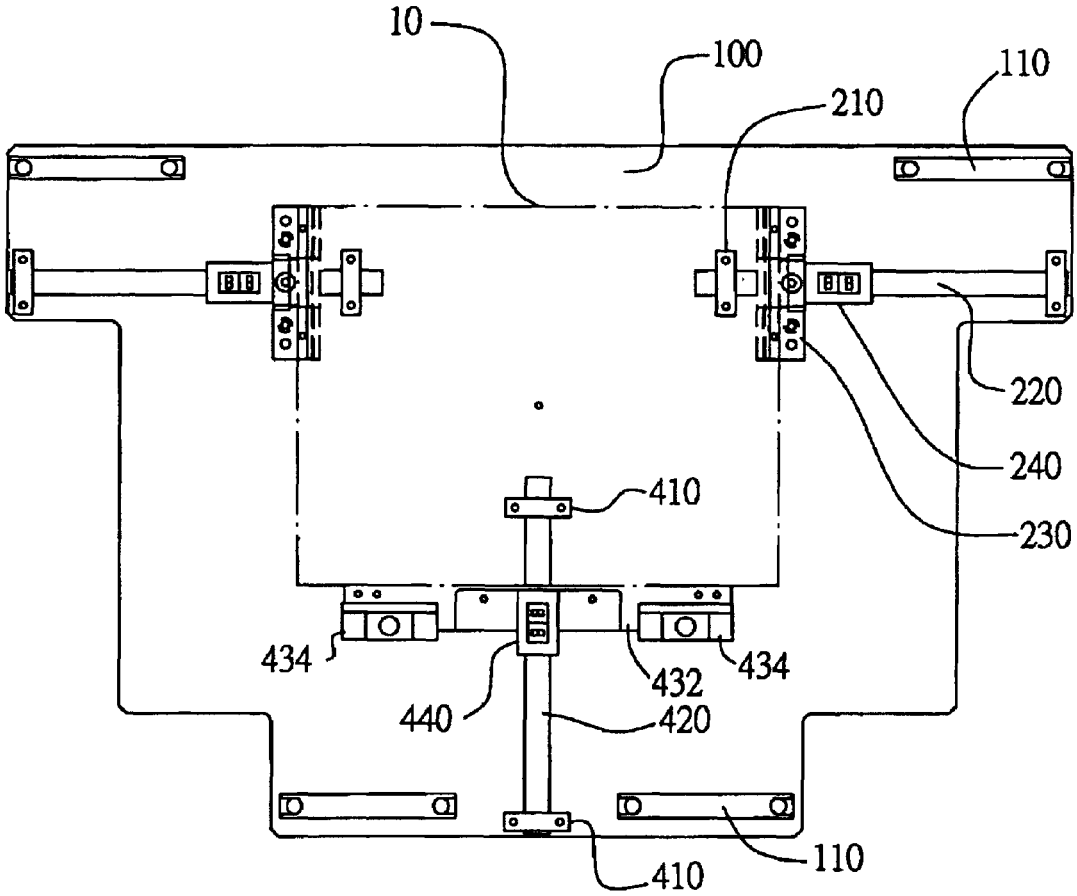
FIG. 7 shows the top view of the adjustable supporting tool for LCD panel according to the second embodiment of the present invention, while the adjustable supporting tool is clamping another LCD panel of different size in position.

Now referring to FIGS. 2 to 4, the adjustable supporting tool for LCD panel 10 according to the first embodiment of the present invention is horizontally placed below the lens 20 of the horizontal optical analyzer. As mentioned before, the clamping member 230 of the transversal clamping device 200 and the clamping device 330 of the longitudinal clamping device 300 can slide along the sliding tracks 220, 230, which have caliper rulers 240, 340 to show the position of the clamping member 230, 330 on the sliding track 220, 320. Therefore, users can determine the position of the clamping member 230, 330 by the displayed numerals of LCD according to the present invention tool, and confirm that the central position of the clamped LCD panel 10 is located at the central positioning point of the optical measurement. Furthermore, the clamping member 230, 330 can slide along the sliding track 220, 230 to fit the LCD panels of different sizes without the need to change supporting tool.

Referring to FIGS. 5 to 8, they show the adjustable supporting tool for LCD panel according to the second embodiment of the present invention. The adjustable supporting tool mainly comprises a baseboard 100, a pair of transversal clamping devices 200 and a longitudinal clamping device 400, wherein the baseboard 100 has a longitudinal axis L and a transversal axis T, and the intersection point of the longitudinal and transversal axes L, T is set as the central positioning point for the optical measurement. Each of the pair of transversal clamping devices 200 has two fixing members 210, and each fixing member is fixed to the transversal axis T. Moreover, a sliding track 220 is disposed between the fixing members 210, and a clamping member 230 slides along the sliding track 220 to clamp the longitudinal edge of a LCD panel 10 in position, and the clamping member 230 is coupled to a caliper ruler 240 which shows the position of the clamping member 230. The of longitudinal clamp device 400 has two fixing members 410 which are fixed to the longitudinal axis L. A sliding track 420 is disposed between the fixing members 410, and a clamping member 430 slides along the sliding track 410 to clamp the transversal edge of an LCD panel 10 in position. Furthermore, the clamping member 430 is coupled to a caliper ruler 440 which shows the position of the clamping member 430. More preferably, a handle 110 is disposed on the baseboard 100, and thus the user can hold the baseboard more easily.

The fixing member 410 and the sliding track 420 of the longitudinal clamping device 400 of the second embodiment of the present invention are the same as those in the first embodiment, therefore they are not described here again. The clamping member 430 includes a press bracket 432 that slides on the sliding track 420, and both ends of the press bracket 432 are coupled to a clamping block. The two transversal clamping devices 200 and the longitudinal clamping device 400 of the second embodiment of the present invention respectively have the locking member 250, 450 to mount the clamping member 230, 430 for adjusting the position to the sliding track 220, 420.

Figure 8:
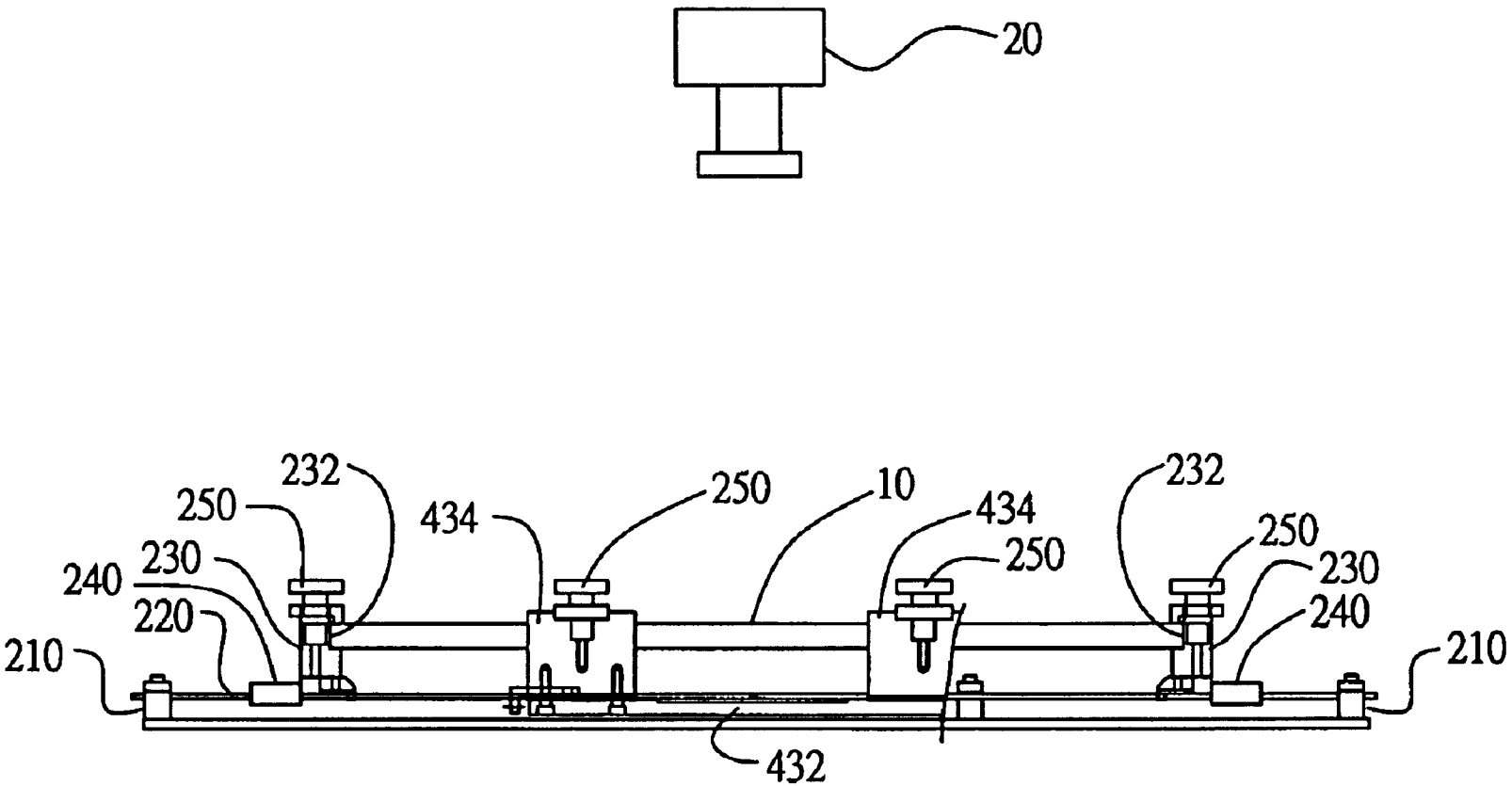
FIG. 8 shows the side view of the adjustable supporting tool for LCD panel according to the second embodiment of the present invention, while the LCD panel is vertically disposed below the lens of the vertical optical analyzer.

Referring to FIG. 8, it shows the adjustable supporting tool for LCD panel according to the second embodiment of the present invention, in which the LCD panel 10 is placed vertically in front of the lens 20 of the optical analyzer. Similar to the first embodiment of the present invention, users can observe the position of the clamping member 230, 240 by the displayed LCD numerals and confirm that the central position of the clamped LCD panel 10 is located at the central positioning point for the optical measurement. Furthermore, the clamping member 230, 430 can slide along the sliding track 220, 420 to fit LCD panels of different sizes without changing the supporting tool.

Although the invention has been explained in relation to its preferred embodiment, it is not used to limit the invention. It is to be understood that many other possible modifications and variations can be made by those skilled in the art without departing from the spirit and scope of the invention as hereinafter claimed.

What is claimed is:

1. An adjustable supporting tool for an LCD panel comprising:

a baseboard having a longitudinal axis and a transversal axis with an intersection point thereof defining a central positioning point for an optical measurement;

a pair of transversal clamping devices for clamping a longitudinal edge of the LCD panel in position, wherein each transversal clamping device has two first fixing members fixed to the transversal axis, a sliding track disposed between the first fixing members, and a first clamping member slidably disposed along the sliding track;

at least one longitudinal clamping device for clamping a transversal edge of the LCD panel in position; and a first caliper ruler attached to the first clamping member to show the position of the clamping member.

2. The adjustable supporting tool for an LCD panel as claimed in claim 1, wherein the first caliper ruler utilizes a first numeral display to show the position of the clamping member and facilitate the observation of a user.

* * * * *